US005850981A

United States Patent [19]

Beausoleil

[11] Patent Number: 5,850,981

[45] Date of Patent: Dec. 22, 1998

[54] HOUSING FOR A RETRACTABLE ROAD MAP

[76] Inventor: Bryan T. Beausoleil, 123 Settlers La., Torrington, Conn. 06790

[21] Appl. No.: 368,019

[22] Filed: Jan. 3, 1995

Related U.S. Application Data

[63] Continuation-in-part of Ser. No. 94,693, Jul. 22, 1993, abandoned.

[51] Int. Cl.[6] ..... G65H 75/30; G09F 11/18

[52] U.S. Cl. ..... 242/385.1; 242/380; 40/517

[58] Field of Search ..... 242/385.1, 379, 242/380; 40/514, 515, 517, 904

[56] References Cited

U.S. PATENT DOCUMENTS 1,570,104 1/1926 Vancil ..... 40/517

*Primary Examiner*—John Q. Nguyen

[57] ABSTRACT

A light weight, semi-rigid, 180 degree tubular, plastic housing and roller shaft assembly permanently assembled into this housing by capturing the ends of the roller shaft assembly inside of the end caps that are bondedly attached to the inside diameter of the housing that allows complete control over the single article wound around the roller shaft assembly. Bondedly attached to its outer diameter at the inner most point where they meet that has an internal spring mechanism that can be tensioned and biased in the retract position at assembly but has attached to the exposed end of the laminated map or the like a magnifying stiffener rod larger than the opening in the housing to secure the same from being pulled completely into the housing by the spring tension of the roller assembly but also serves as a means of pulling the map out of the housing as well as keeping the map stretched out to its full width and provides the viewer with a way to enlarge the small print on maps by looking at the map through the magnifying stiffener rod.

5 Claims, 1 Drawing Sheet

SECT. 2-2

1
2
3
4
5
6
7
8
9
10
11
12
13

SECT. 2-2

1
2
5
6
8
13
14(4)

SECT. 3-3

2
4
12
14(4)

SECT. 1-1

2
3
9
14(3)

HOUSING FOR A RETRACTABLE ROAD MAP

Contiuation in part application with specific reference to earlier filed application Ser. No. 08/094,693 filing date Jul. 22, 1993, abandoned, by first named inventor Bryan T. Beausoleil.

BACKGROUND OF THE INVENTION

1. Field of the Invention

The present invention is a new and improved variation of the prior art for housing a road map or the like in a compact enclosure with complete control for retracting and extending the article inside and the addition of a magnifying stiffener rod to enhance the text of the article.

2. Description of the Prior Art

The prior art in this classification of winding and reeling all have in common a spring loaded roller held in place by a bracket, screw cap, or dome plug on each end of a round enclosure or tube to house the roller assembly as it is exercised by pulling on a sheet of material wound around it.

In the case of U.S. Pat. No. 767,673 for music rolls, a rotating, telescopic case is described to completely seal the paper rolls from the atmosphere or opened to facilitate the changing of the rolls. The case or housing for the preferred embodiment on the contrary is one half open and does not have any moving parts that telescope and contents are not interchangeable.

In reviewing U.S. Pat. No. 2,111,362 for a combined writing instrument and calendar, I find that this would be difficult if not impossible to assemble for the average person and it would have to be ungainly in its size to accommodate such a mechanical device making the instrument unbalanced to write with compared to modern day pens not to mention the coast to manufacture so many small components and the likelihood of any one of those parts getting lost rendering the item useless. The current invention is permanently assembled at point of manufacture and will not have lost parts and will have a long useful life.

In reviewing U.S. Pat. No. 3,245,635 for a pull out display device, I also find similarities to the aforementioned patents but instead of a spring to bias the roller, a rubber band is twisted to provide rotational bias to withdraw the sheet back into the housing. After a short time, even if this arrangement did work, which I doubt, the rubber band is doomed to failure making this design undesirable and useless as witnessed by the fact there are none to be found in the market place now or after invention. On the contrary, the preferred embodiment is selling in stores now and is warranted for one year.

Still another map holder as described in U.S. Pat. No. 2,503,101 contains the same common features as a tubular housing with a slot for the article to be fed through and ends except two individual spindles are rotated to store energy in the spring through a belt arrangement. This too is a doubtful practical holder for a map or display and once a map is removed it is not clear how an average person could possibly reassemble it. Just the mechanical physics required would render this version into a large, un-wieldy item quite unlike the preferred embodiment being small, compact and easy to handle.

In addition to the common characteristics mentioned above, U.S. Pat. No. 3,884,351 has proved itself to be a useful tool to builders and architects as a drawing case, storage case, or carrying case for numerous large drawings and instruments of the trade as well as having a zipper to close it making it waterproof. By that description alone one must realize that this is a large case approximately 4 to 6 inches in diameter by 30 to 48 inches long. It's design and patent being specifically geared to that application of storing many large drawings and it is unlikely one would want such an item along for a trip as a map housing if given the choice between this drawing case and the preferred embodiment. Although size in itself is usually not a patentable difference, the preferred embodiment is small and compact and designed to hold only one map read on both sides. The preferred embodiment does not provide for interchanging of maps or drawings or storage of tools or the like because of the difficulty of handling a spring loaded roller assembly for the average person without the use of tools or fixtures but instead is permanently assembled at the point of manufacture. James mentions "An elongate sheet 15 which is made from a heavy duty vinyl material to support the weight of drawings mounted thereon". (As shown in his FIG. 3). This heavy sheet is the carrier of the drawings mounted to it by fasteners 30. In the preferred embodiment, there is no "carrier sheet" or "fasteners" but instead, the laminated map. James also mentions and shows in FIGS. 4 and 5 "A "U" shaped bracket" to support his spring roller and connected to the inside of the body by screws and the roller assembly prevented from removal by bolt 22. By contrast, the preferred embodiment uses only the end caps 3 and 4 to locate and hold the roller shaft assembly in place. A close review of the attached drawings and claims of the current invention will make clear the full intent of this inventor.

SUMMARY OF THE INVENTION

The purpose of the current invention is to create a better way to handle and use a road map or the like and solve the problems of the prior art mentioned above by providing a semi-rigid tubular housing for light weight and a roller shaft assembly to enable the user to perfectly manipulate the contents such as a road map, display article, navigation chart, or the like in singular form so as to reduce the mass of the case or housing making it compact. This allows for smaller clearances for motion of the map or the like making it easily held by one hand and operated by the other. In addition, the article or map is laminated in polyethylene film to protect it from dirt, and give it strength. Attached to one end of the road map is a stiffener rod that acts as a magnifying glass does when held over the map to enlarge the fine print that is found on all maps.

The present housing assembly is an improvement over the prior art because of a protrusion which is molded into the outside diameter of the housing and is placed in one's hand to counter the rotational forces applied to the housing when the roller assembly is exercised and prevents the housing assembly from turning and slipping out of that hand. A further improvement of the present housing assembly over the prior art is that it is permanently assembled and therefore does not require assembly by others. Furthermore, the present housing assembly can be modified to accommodate different sizes but remain true to the intent of the invention as stated above.

While working on another invention, I made an appointment with a person that lived across the state and I thought I knew how to get there. Of course, I was wrong and made many wrong turns and still would not pull over and retrieve the crumpled, dirty map from under the drivers seat because of the inconvenience. Naturally, I missed the appointment and could not get another one for two weeks. The return trip home was no better for lack of a road map that had long since been run over by the tracks of the seat anyway and made useless. This episode prompted me to think about how other people I know have a similar story to tell at one time or another. I began thinking that not wanting to stop and look at a map is a typical human trait that many wives will testify as being true at least of their husbands. I think the reason people don't stop to read a road map when you need it is usually because it is inaccessible at the moment; or the ungainly size of it; or the fact that it will unlikely get folded back the same way it came . . . nice and neatly folded. The object of the invention became clear to me that day as I drove home:

Slightly modify the housing I already invented and wind a road map around the roller assembly that could withstand the rigors of traveling in an automobile environment and easily be extended to read; held there by the roller assembly stop; and quickly and easily be retracted to store. There is not one like this invention on the market. The invention consists of a housing and roller shaft assembly easily held in your hands. A better understanding of the preferred embodiment and how it operates can be had by referring to the attached drawings and the description of the preferred embodiment.

OBJECTS OF THE INVENTION

The first object of the present invention is to provide a compact, light weight, hand held, injection molded plastic housing for the roller shaft assembly that has a spring that can be tensioned in the retract position.

The second object of the present invention is to attach a road map or the like to the roller shaft assembly that can be easily extended by pulling it out of the housing when needed and be returned to the storage condition wrapped around the roller shaft in the housing neatly and quickly.

The third object of the present invention is to make it durable enough to withstand the rigors of travel and storage in an automobile environment including temperature extremes.

The fourth object of the present invention is to make it attractive and reasonably priced.

The fifth object of the present invention is to provide a magnifying feature to the stiffener rod for the user to read through while moving it over the map's fine print.

PREFERRED EMBODIMENT

Figure 1:
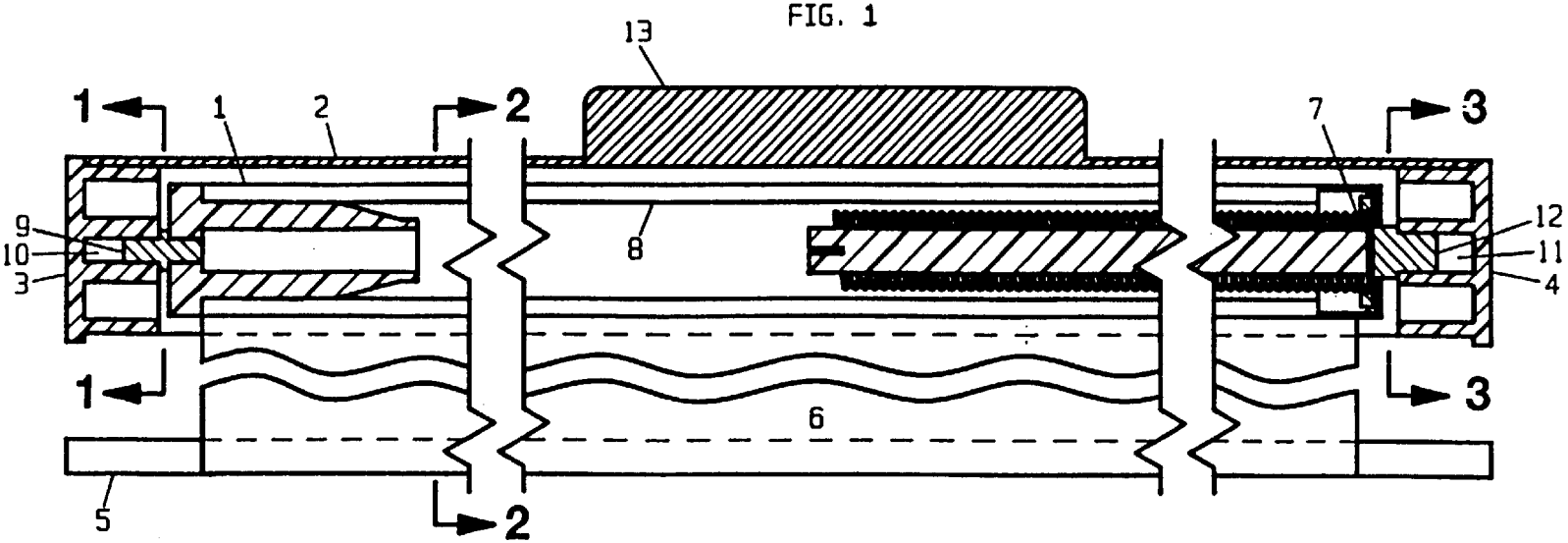
FIG. 1 is an assembly drawing of the housing and roller shaft assembly with a cut-away view taken through the center of the protrusion and housing/roller shaft assembly with the map partially extended from the housing and it also shows the map wound around the roller shaft assembly and three section views.

The drawing in FIG. 1 shows the roller shaft assembly 1 inside of a semi-rigid, light weight, compact, tubular housing 2 made of injection molded ABS plastic with one half its diameter open. ABS plastic is a tough, shatter resistant material and has ultra violet light inhibitors added to it and has been proven in the automotive industry to withstand the rigors of an automotive environment in which this apparatus must operate reliably for a long period of time. Located centrally on the outside diameter of tubular housing 2 is a protrusion 13 molded in to become an integral part of housing 2 but is identified here as 13 to distinguish it as an addition to previously filed drawings. The purpose of this protrusion 13 is to assist your hand in countering the rotational forces applied to tubular housing 2 when the roller shaft assembly is exercised as described below by placing this protrusion 13 between the first and second joint of your hand and grasping both edges of housing 2 with the tops of those fingers will keep tubular housing 2 from turning in your hand.

Map 6 is wound around the outside diameter of roller shaft assembly 1 and map 6 is bondedly attached by adhesive to the roller shaft assembly 1 at the inner most point where they meet. Map 6 is the same width as roller shaft assembly 1.

One end of the roller shaft assembly 1 has one round pin 9 located centrally on its diameter and inserted in the round clearance hole 10 in end cap 3 allowing pin 9 to rotate freely in hole 10 as the roller shaft assembly 1 rotates about this axis. End cap 3 is bondedly attached to one end of the inner diameter of tubular housing 2. The opposite end of roller shaft assembly 1 has in it a rectangular pin 12 located centrally on the diameter of the roller shaft assembly 1 and pin 12 is inserted in the rectangular clearance hole 11 in end cap 4 and is restricted from rotating as the roller shaft assembly 1 turns because end cap 4 is bondedly attached at assembly to the inside diameter of tubular housing 2 opposite end cap 3.

End caps 3 and 4 are also injection molded ABS plastic with their outside body diameter sized to fit the inside diameter of tubular housing 2 and are slid inside of tubular housing 2 until the flange 14 on end caps 3 and 4 seats against the ends of housing 2. The outside diameter of flange 14 has the same outside diameter as tubular housing 2. End caps 3 and 4 are bonded there respectively to opposite ends of tubular housing 2 which holds the assembly together.

The roller shaft assembly 1 is shorter in length than the longitudinal opening in tubular housing 2 after both end caps 3 and 4 are bondedly attached to each end of tubular housing 2 and is smaller in diameter than the inside diameter of tubular housing 2 and is located centrally in tubular housing 2 by pin 9 inserted into hole 10 which is located centrally in end cap 3. Pin 12 is inserted into hole 11 which is located centrally in end cap 4 and thus allows for clearance between the inside diameter of housing 2 and the outside diameter of roller shaft assembly 1 after map 6 is rolled up on the outside diameter of roller shaft assembly 1 as the roller shaft assembly 1 is rotated on its axis inside of tubular housing 2.

The roller shaft assembly 1 is also slightly smaller in diameter than the inside diameter of tubular housing 2 enough so as to allow rotational movement without interference after map 6 has been attached. The roller shaft assembly 1 has inside it a spring mechanism 7, that is tensioned by the rotary motion of the shaft as it turns on its axis, with its construction typical of the physics of the prior art for window shade rollers and is well known. One end of map 6 is bondedly attached to the roller shaft assembly 1 as described above and the other end of map 6 is bondedly attached to the magnifying stiffener rod 5. Magnifying stiffener rod 5 is a solid diameter rod made of optically clear acrylic plastic material with a parabolic shape on one side and a flat bottom on the other side. When the flat bottom of stiffener rod 5 is placed on map 6 and viewed from above, the parabolic shape acts as a lens does to change the focal point and magnifies the small print beneath it. Small print is typically found on all maps and is hard to read for most people without perfect eye sight. Magnifying stiffener rod 5 also serves to hold map 6 at it's full width and keep it there without curling from the edges as it would do without it because the paper of map 6 is only paper thin. In order to increase the strength and durability of the map 6 member, a thin plastic film with adhesive on both sides is heated and bonded to map 6 as in the manner of laminating.

A person can operate this holder by applying increasing pressure with one hand in the direction to extend the map to the magnifying stiffener rod 5 that is bondedly attached to map 6 which is bondedly attached to the outside diameter of core 8 of the roller shaft assembly 1 and the other hand holding tubular housing 2 with protrusion 13 held between the first and second joint of the fingers and the tips of the fingers grasping each edge of the tubular housing 2 and pulling housing 2 in the opposite direction with equal but increasing force, will cause the roller shaft 1 to rotate on its axis on pin 9 in end cap 3 while pin 12 is being held from turning by end cap 4 bonded in its place inside housing 2 and thereby exercising the spring mechanism 7 inside the core 8 of roller shaft assembly 1, retraction tension or energy is stored in the spring mechanism 7 and applied to retract map 6 into housing 2 as the roller shaft assembly 1 rotates about it's axis. This stored energy in spring 7 created by the rotational motion of the roller assembly 1 causes an equal but opposite reaction of the housing assembly 2 making it want to spin or rotate in your hand. This counter rotational force is controlled by placing protrusion 13 in your hand as described above restricting this rotation.

Map 6 can be held extended to any desired length by the typical action of the cogs and notched wheel (not shown in drawing) of the roller shaft assembly 1 reacting to centrifugal force as the shaft turns or does not turn. A person can retract the map by releasing this tension first by changing the position of tubular housing 2 from a horizontal or parallel to the ground position to ninety degrees from horizontal to vertical position and applying equal and opposite increasing pressure with each hand, one hand holding the magnifying stiffener rod 5 and the other hand holding tubular housing 2 with protrusion 13 held between the first and second joint of the fingers and the tips of the fingers holding each edge of tubular housing 2, in the direction for extension of the article for a moment, and then quickly releasing this pressure, will cause the energy stored in spring assembly 7 to rotate the roller assembly in the opposite direction rapidly causing the cogs in the notched wheel to disengage due to centrifugal force causing map 6 to reciprocate into the longitudinal opening in tubular housing 2 and wrap itself around the outside diameter of roller shaft assembly 1. Map 6 will not retreat completely into housing 2 because it is bondedly attached to the magnifying stiffener rod 5 which is larger than the longitudinal opening in tubular housing 2 and will be stopped there due to its size being to large to enter that opening.

According to the present invention, it is obvious that all of the parts may be made larger or smaller by the same ratio to accommodate different sized maps or articles.

Figure 2:
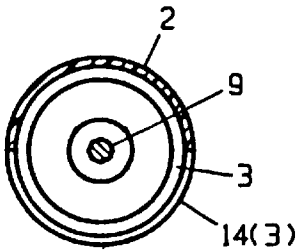
FIG. 2 is a view of section A—A of FIG. 1.

FIG. 2 or section A—A of FIG. 1 is a view of end cap 3 as cut through pin 9 and housing 2. Pin 9 fits in the clearance hole 10 centrally located in end cap 3. The flange 14(3) on end cap 3 is shown seated against one end of housing 2.

Figure 3:
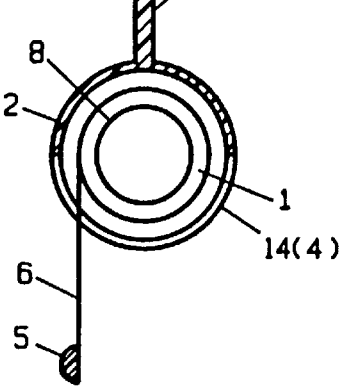
FIG. 3 is a view of section B—B of FIG. 1

FIG. 3 or section B—B of FIG. 1 is a view as cut through the entire assembly. Showing a cross section of the roller shaft assembly 1; map 6 rolled around the roller shaft assembly and partially extended; tubular housing 2; end cap 4; and magnifying stiffener rod 5.

Figure 4:
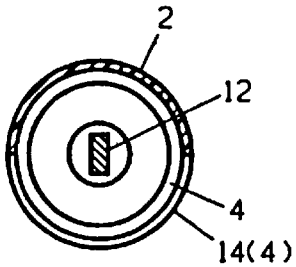
FIG. 4 is a view of section C—C of FIG. 1

FIG. 4 or section C—C of FIG. 1 is a view of end cap 4 as cut through rectangular pin 12 and tubular housing 2. Pin 12 fits into clearance hole 11 centrally located in end cap 4. The flange 14(4) is shown seated against the opposite end of housing 2 from end cap 3.

I claim:

1. A spring-loaded map winding device for housing and winding a road map or chart comprising, a tubular housing having an opening extending axially the entire length of the housing, a spring-loaded roller shaft assembly positioned within the tubular housing, said road map or chart having one end attached to said spring-loaded roller shaft assembly and an opposite end attached to a magnifying stiffener rod located outside of said tubular housing, said spring-loaded roller shaft assembly resiliently urging said road map or chart to wind around said spring-loaded roller shaft assembly, a mechanism for holding said road map or chart extended at a desired length from said tubular housing, end caps attached to the axial ends of the tubular housing, said end caps having respective cylindrical portions extending inside the tubular housing and delimiting the length of the opening into the interior of the tubular housing, said magnifying stiffener rod having a length longer than the delimited opening to prevent said rod from being retracted inside said tubular housing, and being made of an optically clear acrylic plastic material and having, in cross-section, a parabolic shape on one side and a flat bottom surface on the other side.

2. The device of claim 1 wherein the tubular housing is made of ABS plastic.

3. The device of claim 1 wherein an elongated protrusion is formed on an outer surface of the tubular housing to facilitate grasping the tubular housing during use.

4. The device of claim 3 wherein the tubular housing and the elongated protrusion is made of ABS plastic.

5. The device of claim 1 wherein a thin plastic film is laminated over the road map or chart to increase durability of the road map or chart.

* * * * *